US009282824B2

(12) United States Patent
Grace

(10) Patent No.: US 9,282,824 B2
(45) **Date of Patent: *Mar. 15, 2016**

(54) COLLAPSIBLE AND PORTABLE ROCKING CHAIR

(71) Applicant: GCI Outdoor, Inc., Higganum, CT (US)

(72) Inventor: Daniel R. Grace, Old Saybrook, CT (US)

(73) Assignee: GCI OUTDOOR, INC., Higganum, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/746,117

(22) Filed: Jun. 22, 2015

(65) Prior Publication Data

US 2015/0282625 A1 Oct. 8, 2015

Related U.S. Application Data

(63) Continuation of application No. 14/047,608, filed on Oct. 7, 2013, now Pat. No. 9,060,611.

(60) Provisional application No. 61/710,238, filed on Oct. 5, 2012.

(51) Int. Cl.

| | |
|---|---|
| ***A47C 3/02*** | (2006.01) |
| ***A47C 4/28*** | (2006.01) |
| ***A47C 3/025*** | (2006.01) |
| *A47D 1/02* | (2006.01) |
| *A47D 9/02* | (2006.01) |
| *A47D 13/10* | (2006.01) |
| *A47D 9/00* | (2006.01) |
| *A47C 3/029* | (2006.01) |

(52) U.S. Cl.

CPC ..... *A47C 4/283* (2013.01); *A47C 3/025* (2013.01); *A47C 3/0255* (2013.01); *A47C 3/02* (2013.01); *A47C 3/029* (2013.01); *A47C 4/286* (2013.01); *A47D 1/02* (2013.01); *A47D 9/005* (2013.01); *A47D 9/02* (2013.01); *A47D 13/10* (2013.01); *A47D 13/102* (2013.01)

(58) Field of Classification Search

CPC ..... A47D 9/02; A47D 9/005; A47D 13/10; A47D 1/02; A47D 13/102; A47C 3/029; A47C 4/286; A47C 3/02

USPC ..... 297/39, 59, 55, 56, 42, 16.1, 19, 16.2, 297/45, 46, 378.1, 32, 258.1, 271.5, 131, 297/259.1

See application file for complete search history.

(56) References Cited

U.S. PATENT DOCUMENTS 3,114,572 A * 12/1963 Hopkins ..... 297/33
4,285,543 A * 8/1981 Clark ..... A47C 3/029 297/133

(Continued)

*Primary Examiner* — Chi Q Nguyen
(74) *Attorney, Agent, or Firm* — McCormick, Paulding & Huber LLP

(57) ABSTRACT

A collapsible and portable rocking chair includes left and right frame side assemblies collectively defining forward and rear leg portions, armrests, and back support members. The chair also includes cross-members connecting the left and right frame said assemblies and collectively defining a seat support in the set-up condition of the chair. The cross members are pivotally connected to one another as well as to the left and right frame side assemblies to facilitate folding of the chair frame to a collapsed condition. Each frame side assembly is supported on a fulcrum point for rocking movement of the chair frame. A rocker mechanism is attached to the chair frame to support the chair during rocking movement and to facilitate rocking of the chair in connection with the user's shifting weight. The rocker mechanism may be provided in connection with a front leg member, a rear leg member, or both.

20 Claims, 7 Drawing Sheets

(56) References Cited

U.S. PATENT DOCUMENTS 5,992,929 A * 11/1999 Liu ..... 297/33
6,082,813 A * 7/2000 Chen ..... 297/16.2
6,398,297 B1 * 6/2002 Cantwell ..... 297/33
6,439,656 B1 * 8/2002 Liu ..... 297/33
7,100,975 B1 * 9/2006 Zheng ..... 297/32
9,060,611 B2 * 6/2015 Grace

* cited by examiner

COLLAPSIBLE AND PORTABLE ROCKING CHAIR

CROSS-REFERENCE TO RELATED APPLICATIONS

This application claims the benefit of U.S. Ser. No. 14/047,608 filed Oct. 7, 2013, now U.S. Pat. No. 9,060,611, and Provisional Application No. 61/710,238, filed Oct. 5, 2012, which are both incorporated herein by reference.

FIELD OF THE INVENTION

The present invention generally relates to folding chairs, and more particularly relates to improvements in rocking chairs that are foldable and unfoldable between a set-up condition for use and a substantially collapsed condition for transportation and/or storage.

BACKGROUND OF THE INVENTION

Popularity of the mini van, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved collapsible furniture for the picnicker, sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort. The wooden beach chairs and lawn furniture of an earlier era have generally been replaced by light-weight tubular metal furniture of a more modern design. However, little has been done to optimize the collapsibility and portability of the full-sized article without compromising comfort, which is a goal of the present invention.

Beach and lawn chairs adapted to be folded for transportation and/or storage typically have a frame fabricated from elongated structural members, preferably metal. The frames of such chairs have transversely spaced-apart left-hand and right-hand frame side assemblies that are substantially parallel to each other. In a set-up condition, each frame side assembly has a front leg member extending in a generally vertically upward direction and a rear leg member pivotally connected at its upper end directly or indirectly to an upper end of the front leg member and which is rearwardly and downwardly inclined from the upper end of the front leg member. Such frame side assemblies also include an upwardly extending chair back support member which is pivotally connected at its lower end to the rear leg member intermediate the ends of the rear leg member by an over-the-center linkage that positions the back support member so that it is supported at its lower end on the rear leg member and inclined upwardly and rearwardly therefrom when the chair is unfolded from its closed or flatly folded storage condition to its open or set-up condition for use. Such frame side assemblies also include a seat support member generally supported by the front and rear leg members in a generally horizontal condition when the chair is in its set-up condition.

Conventional beach and lawn chairs of the prior art having the left-hand and right-hand frame side assemblies such as hereinbefore generally described also commonly have transversely extending rigid connecting members providing fixed connection between the front leg members, the rear leg members, and often the back support members as well. Additional rigidly fixed transverse connecting members may also extend between the structural members that support the seat of such a chair. The aforesaid rigid or non-collapsible transversely extending connecting members are generally horizontally disposed when such a conventional prior art chair is in its set-up condition.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. Due to the intricate interconnection of all the frame members, both front-to-back and side-to-side, such chairs often require all the legs to remain in contact with the ground to ensure safety and structural integrity of the chair during use. However, there is a desire for a rocking chair that is likewise foldable and portable, so that a user at a picnic or an outdoor event can rock in their chair or recline as desired. Prior art foldable and portable chairs, such as those described above, have not been capable of rocking due to the design and construction of such chairs. Adding components to help the user rock in the chair while seated has often compromised the ability to fold the chair for storage or keep it sufficiently lightweight for easy transportation. Moreover, existing foldable rocking chair design, such as illustrated in FIG. 1, are typically not suitable for most outdoor uses, especially on soft ground or sand. The limitations of such prior art chairs are mostly due to the use of arched rails to support the chair frame. With such arched rails, each side of the chair only maintains a single contact point with the ground, which on sand or soft ground increases the risk that one or both sides of the chair will sink into or get bogged down, affecting rocking of the chair and, more significantly, affecting the integrity and safety of the chair to support a seated user.

An additional limitation of prior art rocking chairs, such as shown in FIG. 1, is that they can only be used as a rocking chair, and cannot be stabilized to be used as a normal chair that does not rock.

Other chair designs have been developed that can be folded to a collapsed or bundled state occupying less storage space. For example, some chair designs can be folded in multiple directions, reducing at least the front/back and left/right dimensions between an unfolded set-up condition and a folded, storage condition. However, these chair designs are typically not suitable for certain outdoor uses, such as at the beach or at a picnic. Heretofore, multi-directional foldable chairs have not been capable of rocking due to the complexity of the means of connecting the various frame members constituting the chair frame, as well as the need to keep all the legs of such chairs grounded to ensure safety and integrity of the chair during use.

In view of the foregoing, there is a need for a chair that can be rocked by a seated user when in a set-up condition that can also be collapsed in order to reduce the space occupied by the chair in a folded condition. Further, there is a need for such a chair that can be folded with minimal effort, without limiting or compromising the structural features permitting rocking of the chair. Further, there is a need for a chair that can be rocked by a seated user, as desired, without compromising the folding and transport or the chair, and without affecting the safety and structural integrity of the chair, especially on all types of surfaces, including soft ground and sand. Accordingly, it is a general object of the present invention to provide a foldable and portable rocking chair design that overcomes the problems and drawbacks associated with folding chairs and rocking chairs, and therefore significantly improves the utility of such a chair in the set-up condition while permitting easy transportation and/or storage in a collapsed condition.

In general, there is a need for a collapsible chair that can be easily folded by a user with minimal effort, and which, when set-up, can be used both as a standard, stabilized chair, or alternately, as a rocker, without the need for the user to change the structure of the chair, in any way.

The present invention addresses these issues, and provides a means to circumvent the associated drawbacks of such prior art foldable chair designs.

SUMMARY OF THE INVENTION

The present invention is directed to a collapsible and portable rocking chair design especially suitable for use as a beach chair, a lawn chair, and the like, where the chair, in a set-up condition, can be rocked by a seated user, and where the chair can be folded from the set-up condition to a collapsed condition for transportation and/or storage.

In accordance with the present invention, a collapsible and portable rocking chair includes left and right frame side assemblies collectively defining forward and rear leg portions, armrests, and back support members. The chair also includes cross-members connecting the left and right frame said assemblies and collectively defining a seat support in the set-up condition of the chair. The cross members are pivotally connected to one another as well as to the left and right frame side assemblies to facilitate folding of the chair frame to a collapsed condition. In a preferred design, the cross-members each comprise front and rear portions that are pivotally connected about respective central pivot points to generally assume the shape of an X when the chair is in the set-up condition and that are disposed in generally parallel relationship when the chair is folded or collapsed for transportation and/or storage. The chair further includes a seat panel supported by the seat support and a backrest panel supported by the backrest support for collectively accommodating a user seated in the chair.

In preferred embodiments of the rocking chair, each frame side assembly is supported on a fulcrum point for rocking movement of the chair frame. Each side frame assembly preferably utilizes a static runner design wherein each side frame assembly generally maintains two or more contact points with the ground or support surface during use of the chair, either as a normal, fully stabilized chair, or during rocking of the chair back-and-forth. In alternate designs, the runner may be completely replaced by multiple contact points, including at least one fulcrum point on each side frame assembly, again with the chair operating as a normal, fully stabilized chair or as a rocker with two or more contact points with the ground or support surface during use of the chair.

In preferred embodiments of the rocking chair, a rocker mechanism is attached to the chair frame to support the chair during rocking movement and to facilitate rocking of the chair in connection with the user's shifting weight. In one embodiment, the rocker mechanism comprising a tubular extension member projecting outwardly and downwardly from the rear of the frame side assemblies and received within a sleeve housing a compression spring to which the tubular extension member is attached. The lower end of the sleeve is associated with a foot that contacts the ground or support surface for bracing the chair as it is rocking, with the compression spring damping the chair as it rocks backwards and biasing the chair forwards.

In an alternate embodiment of the rocking chair, a rocker mechanism may be provided in connection with a front leg member or forward portion of the frame side assemblies, either in combination with or in lieu of the rear rocker mechanism. In another alternate embodiment, a rocker mechanism may be provided in connection with both the front leg member and a rear leg member on each side of the chair frame, each positioned about a fulcrum point. In still another alternate embodiment, the rocker mechanism comprises a torsion spring operatively associated with the fulcrum point of each frame side assembly.

Accordingly, in a first aspect of the present invention, a collapsible and portable rocking chair comprises a chair frame comprising a pair of frame side assemblies having substantially mirrored construction and being relatively movable with respect to one another between a set-up condition of said chair where said frame side assemblies are transversely spaced apart form one another and a collapsed condition of said chair where said frame side assemblies are generally adjacent to one another. Each frame side assembly includes a front leg portion and a rear leg portion. The chair also includes a pair of generally U-shaped cross members pivotally connected to one another for pivotal movement between an open condition wherein said cross members are disposed to generally resemble an X-shaped configuration and a closed condition wherein said cross members are disposed in generally parallel relationship with one another. The open and closed conditions of the cross members generally correspond to the set-up and collapsed conditions of the chair. Each cross member has its terminal ends pivotally secured to the front and rear leg portions of one of the frame side assemblies, and the cross members collectively define a seat support that receives a flexible seat panel mounted therebetween defining a generally taut seat when the cross members are in the open condition. The chair further comprises a fulcrum point supporting the chair frame and about which said chair frame can move between forward and rearward positions, and at least one rocker mechanism attached to the chair frame for supporting the chair during movement of the chair frame between said forward and rearward positions.

In another aspect of the present invention, a collapsible and portable rocking chair comprises a chair frame comprising a pair of frame side assemblies having substantially mirrored construction and being relatively movable with respect to one another between a set-up condition of said chair where said frame side assemblies are transversely spaced apart form one another and a collapsed condition of said chair where said frame side assemblies are generally adjacent to one another. Each frame side assembly includes a front leg portion and a rear leg portion, and a fulcrum point supporting each frame side assembly and about which the chair frame can move between forward and rearward positions whereby the front and rear leg portions move relative to the support surface on which the chair is set up with movement of the chair frame about the fulcrum points. The chair also includes a pair of generally U-shaped cross members pivotally connected to one another for pivotal movement between an open condition wherein said cross members are disposed to generally resemble an X-shaped configuration and a closed condition wherein said cross members are disposed in generally parallel relationship with one another. Each cross member has its terminal ends pivotally secured to the front and rear leg portions of one of the frame side assemblies, and the cross members collectively define a seat support that receives a flexible seat panel mounted therebetween defining a generally taut seat when the cross members are in the open condition. The chair further includes a first foot associated with the front leg portions of each frame side assembly, a second foot associated with the rear leg portion of each frame side assembly, and a third foot associated with the fulcrum point of each frame side assembly. Further, each frame side assembly contacts the support surface on which it is set up with at least two of the first, second, and third feet at all positions between the forward and rearward positions of the chair frame.

In another aspect of the present invention, the chair can be used as a normal, stabilized chair in its forward position and will only rock when the user chooses to rock. In this regard, the chair of the present invention is distinct from prior rocking chair designs in which the chair is capable of rocking at all times, often by the slightest shift of the user's weight.

These and other features of the present invention are described with reference to the drawings of preferred embodiments of a collapsible and portable rocking chair. The illustrated embodiments of features of the present invention are intended to illustrate, but not limit the invention.

DETAILED DESCRIPTION OF EMBODIMENTS OF THE INVENTION

Figure 2:
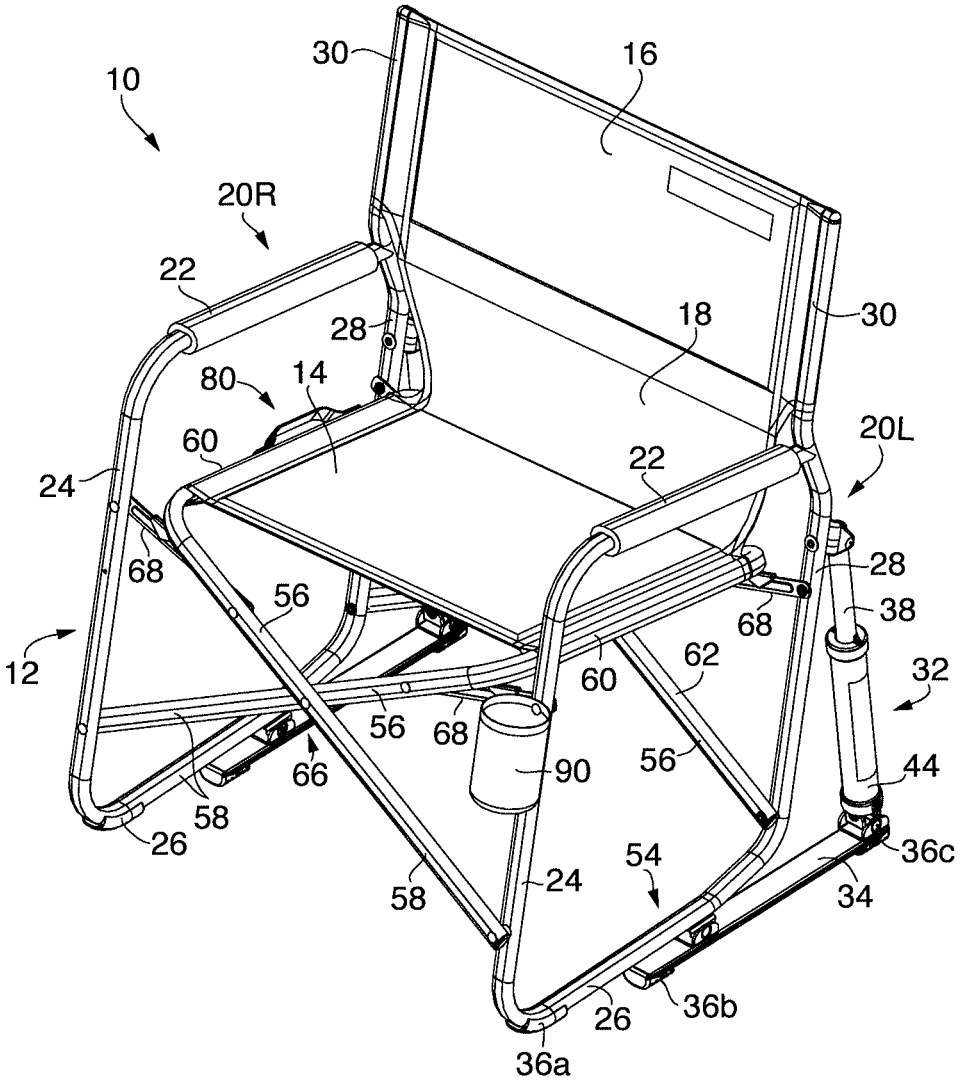
FIG. 2 is a perspective view of a collapsible and portable rocking chair in accordance with an embodiment of the present invention, with the chair in a set-up condition, and with the chair in a forward, stabilized position.

In the drawings and in the description that follows the present invention is illustrated and described with reference to collapsible and portable rocking chair designs embodying the present invention. A first embodiment of a rocking chair in accordance with the present invention is shown, for example, in FIG. 2 in a set-up condition ready for use and generally designated by reference numeral 10. The chair 10 includes a frame 12 that carries a generally rectangular seat support panel 14 and a generally rectangular backrest support panel 16. As illustrated in FIG. 2, the seat panel 14 and the backrest panel 16 comprise generally flexible panels that are connected by a flexible connector panel 18, though the panels 14 and 16 can be separate pieces without departing from the spirit and principles of the present invention. The panels 14 and 16 are generally taut when the chair 10 is in its set-up condition for accommodating and supporting a seated user.

In general, the frame 12 is comprised of several frame members rigidly and/or pivotally connected together to define the chair frame 12 and permit folding and collapsing of the frame 12 to a condition suitable for easy transportation and storage. Preferably, the frame members are fabricated from a durable lightweight material such as a tubular metal or high-strength plastic. Various elongated structural parts or members that comprise the chair frame 12 are preferably constructed from tubular material of non-circular cross-section, such as, for example, extruded aluminum tubing having square, oval, or elliptical cross-section, or, alternately, of circular cross-section.

Figure 3:
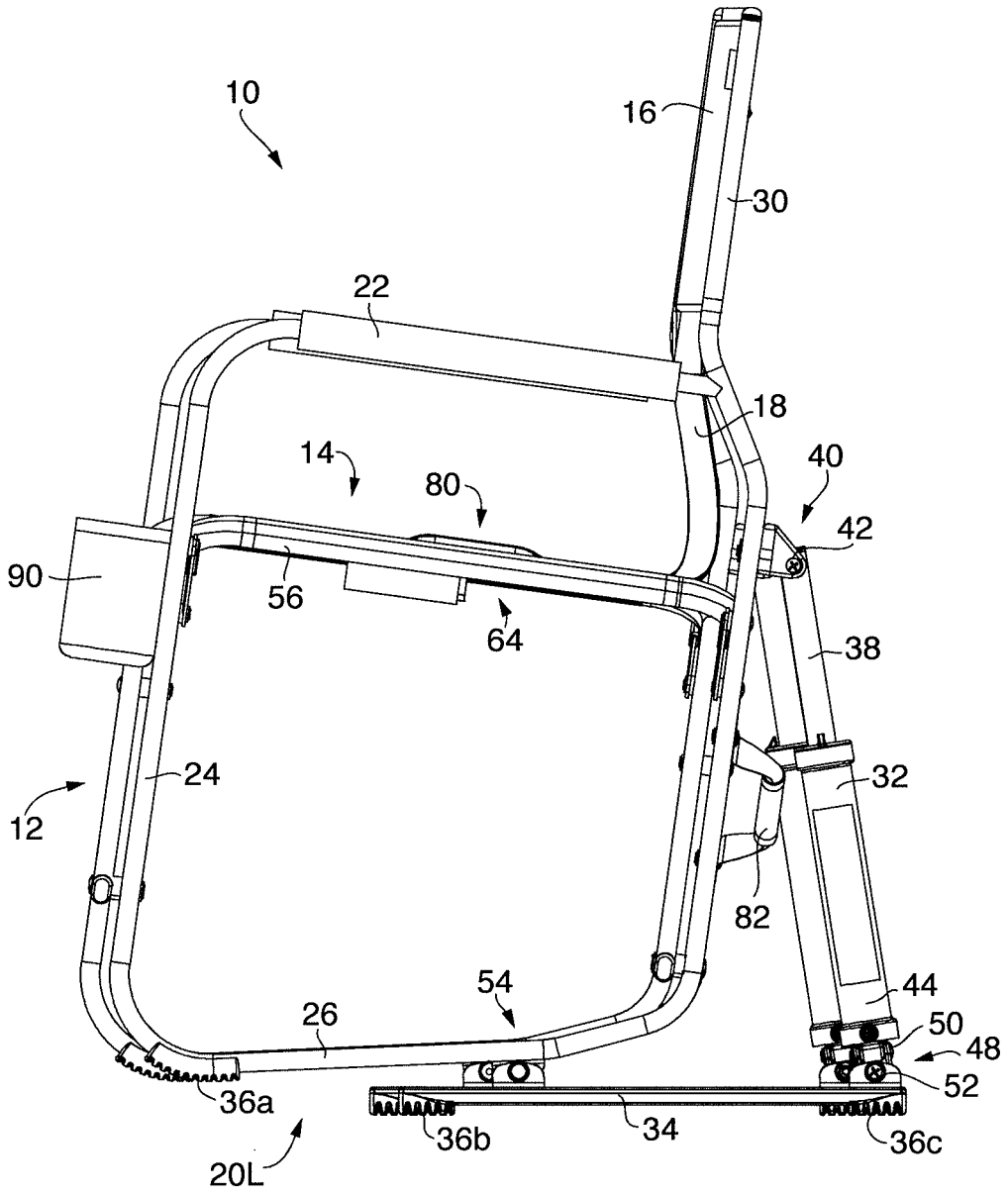
FIG. 3 is a planar side view of the rocking chair of FIG. 2, also in a forward position.
Figure 4:
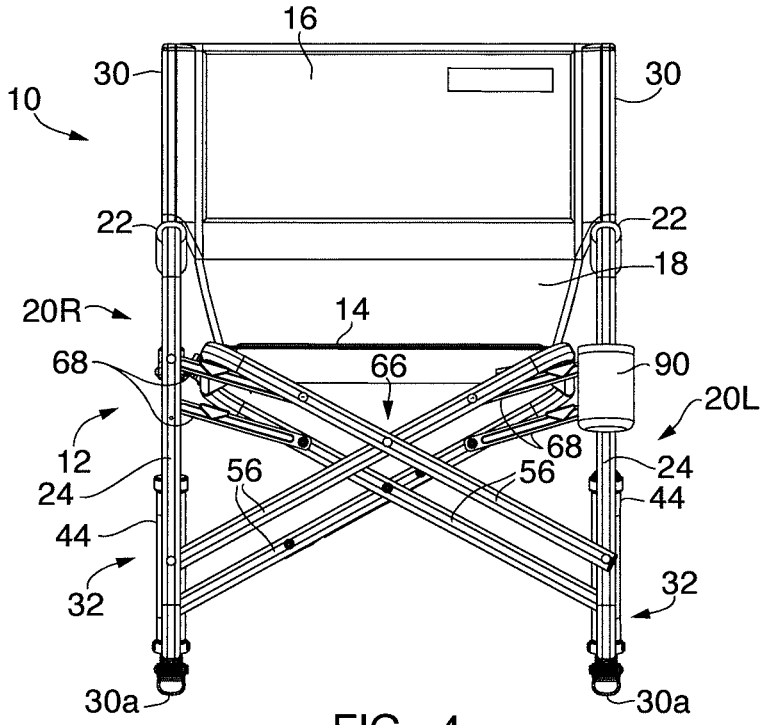
FIG. 4 is a planar front view of the rocking chair of FIG. 2.
Figure 5:
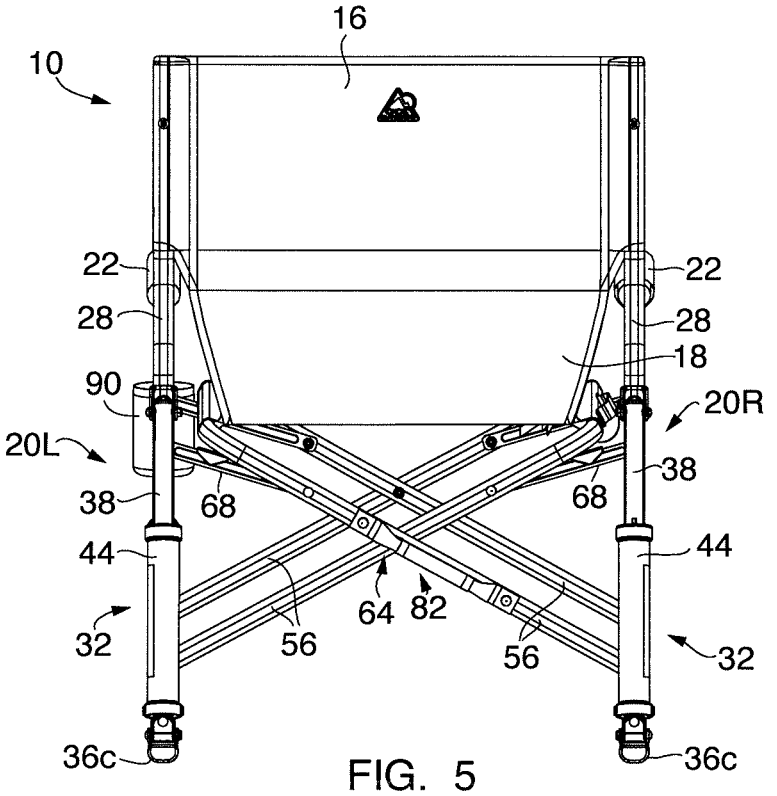
FIG. 5 is a planar rear view of the rocking chair of FIG. 2.
Figure 9:
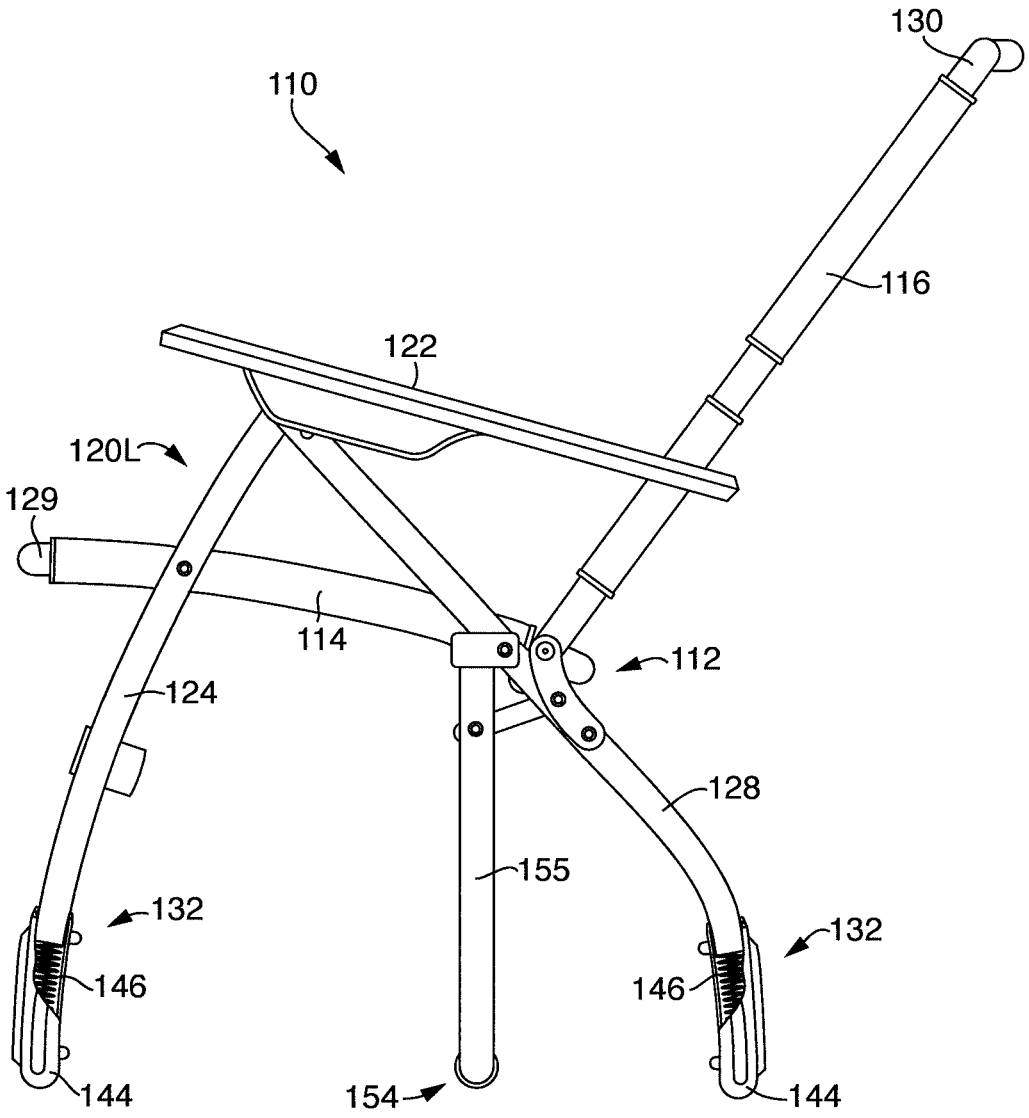
FIG. 9 is a planar side view of an alternate embodiment of a collapsible and portable rocking chair in accordance with the present invention, with the chair in a set-up condition.

Referring to FIGS. 2-5, the frame 12 has a pair of side assemblies 20 comprised of frame members and having substantially identical, but mirrored, construction. The left and right frame side assemblies, respectively designated as 20L and 20R in FIGS. 4 and 5, are disposed in laterally or transversely spaced apart and generally parallel relation to each other when the chair 10 is in its set-up condition. In the illustrated embodiment, the side frame assemblies 20L and 20R are interconnected to be transversely collapsed, or folded side-to-side, to the folded condition of the chair 10, generally shown in FIG. 7. The present invention is easily adaptable for use with chair frame designs that are collapsed in different manners, including but not limited to front-to-back folding generally associated with standard folding chairs. A front-to-back folding chair that incorporates the rocking capability of the present invention is illustrated in FIG. 9.

Considering now one embodiment of a frame side member assembly 20, as shown in FIG. 3, the frame side assembly 20 includes a generally closed frame loop constructed from axially-elongated tubular material that is bent to define an armrest portion 22, a front leg portion 24, a lower support portion 26, and a rear leg portion 28. As shown, the frame loop extends upwardly from the rear leg portion 28 to define a backrest support member 30 rigidly attached to the closed frame loop. Though illustrated as being formed from a singular tubular member, the frame side assembly 20 may be constructed from multiple tubular members without departing from the spirit and principles of the present invention. For example, the backrest support member 30 may be constructed from a separate axially-elongated tubular material and be attached to the rear leg portion 28 of the frame loop. In alternate embodiments, the backrest support member 30 can be removably attached to each frame side assembly 20 to facilitate set-up and collapse of the chair 10, as discussed in more detail below. Removal of the backrest support member 30 during collapse can further reduce the storage and transportable size of a collapsed chair 10.

Further, each portion of the illustrated frame loop can be a separate member, with the various frame members being interconnected by rigid or flexible joints to collectively define the frame side assembly 20. Still further, the frame side assembly 20 may be constructed from an open design instead of a closed frame loop, including the set-up of a front and rear leg generally associated with standard folding chair designs, such as shown in FIG. 9, where the frame members are interconnected by rigid, pivotal, sliding and/or telescopic joints to effect easy folding and unfolding of the chair between a set-up and collapsed condition.

Figure 1:
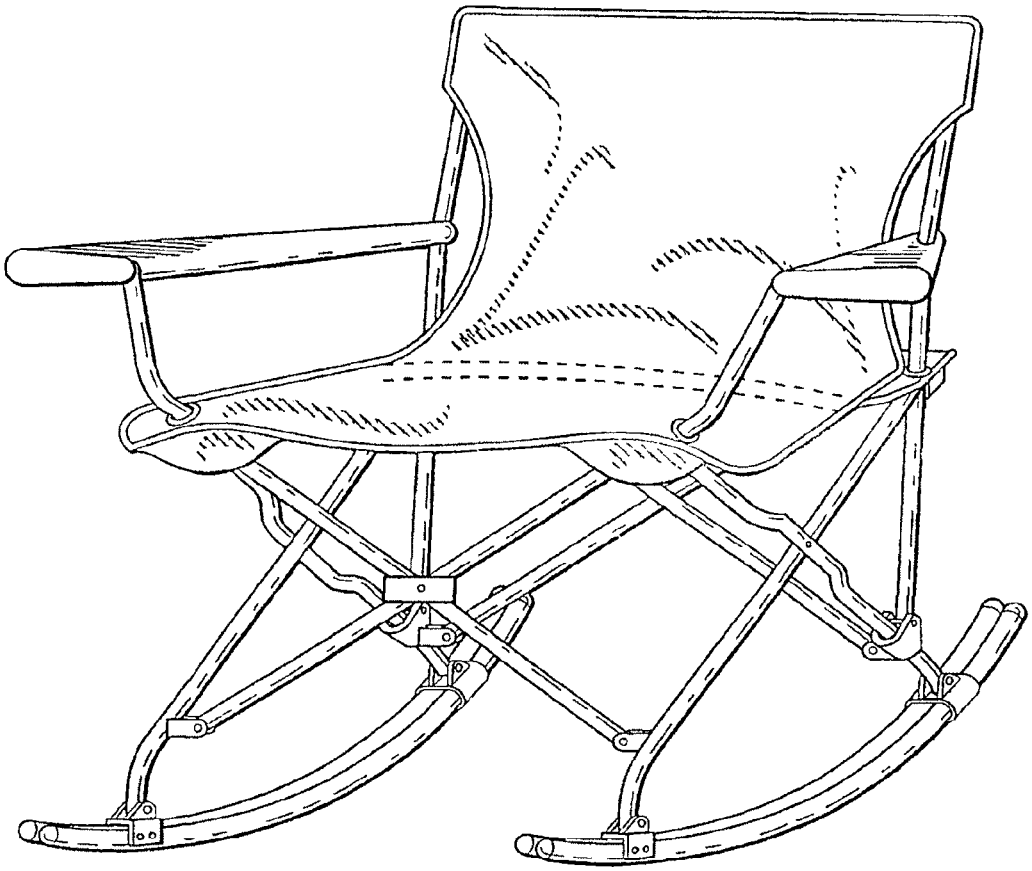
FIG. 1 Prior Art
FIG. 1 is a perspective view of a prior art collapsible and portable rocking chair with the chair in a set-up condition for rocking by a seated user.
Figure 6:
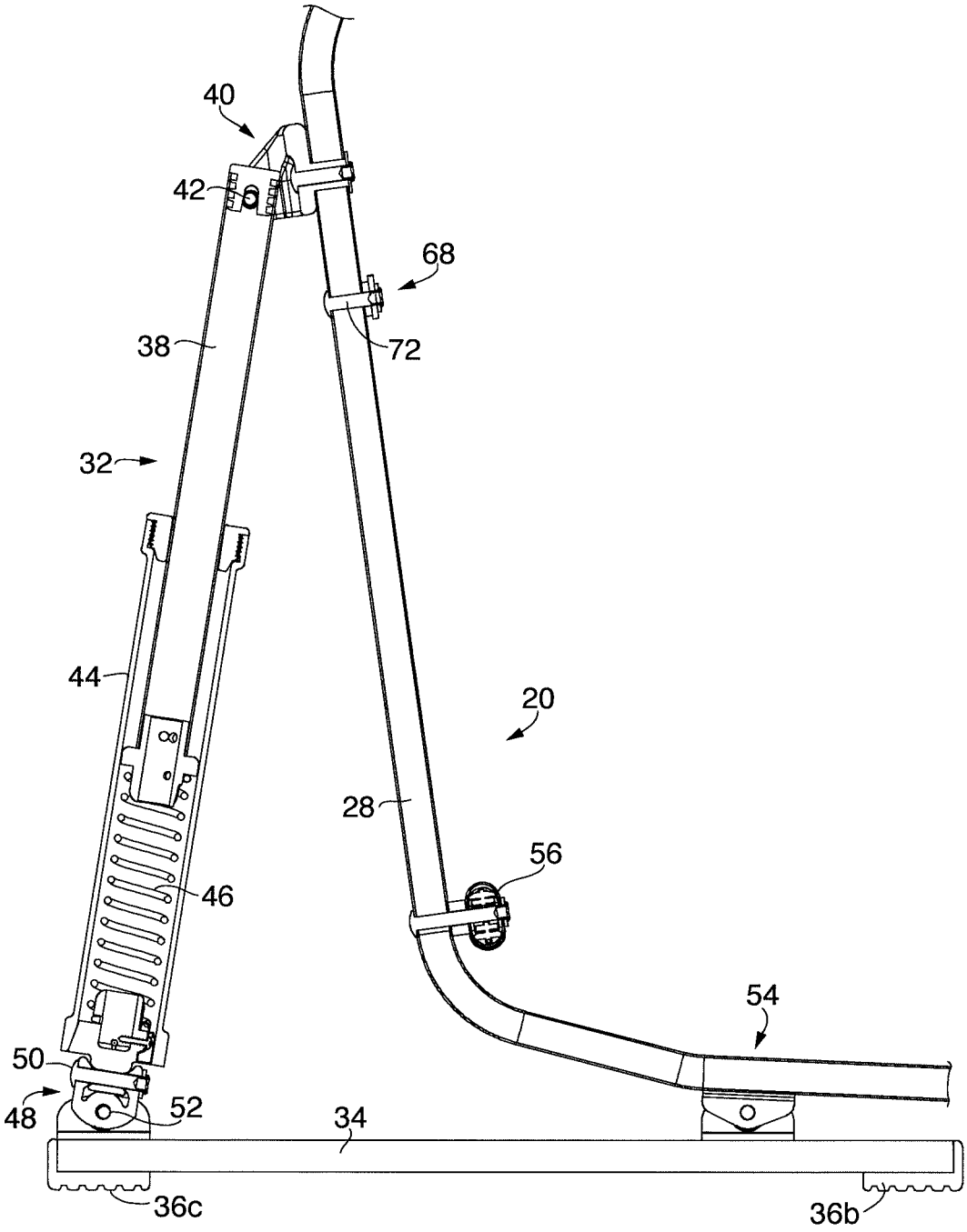
FIG. 6 is a cross-sectional view of a rocker mechanism for use with the rocking chair of FIG. 2.

Referring to FIGS. 2 and 6, a rocker mechanism 32 is attached to the rear of the frame loop. As shown, the rocker mechanism 32 extends angularly outwardly and downwardly from the backside of the frame loop—generally at the location where the armrest portion 22, the rear leg portion 28, and the backrest support member 30 are connected together—to a support runner 34 for supporting and facilitating a back-and-forth rocking movement of the chair 10 when a seated user wants to rock. In the embodiment illustrated in FIG. 2, the support runner 34 also supports the lower support portion 26 of the frame side assembly 20 and is generally disposed beneath the rear leg portion 27 of the frame loop. The rocker mechanism 32 is preferably attached to a static runner design, such as illustrated, that presents a significant improvement over prior art rocking chair designs using arched rails, such as illustrated in FIG. 1, especially in regards to use on soft ground or sand, on which prior art rocking chair designs are ill suited.

Referring to FIG. 3, the rocking chair 10 is provided with three feet 36 on each frame side assembly 20, acting as contact points between the chair 10 and the ground or support surface on which the chair is placed for use. In preferred use of the chair 10, regardless of embodiment, at least two of these feet 36 or contact points for each frame side assembly 20 are in contact with the ground or support surface on which the chair 10 is resting at all times. In this way, the rocking chair 10 of the present invention is distinct from traditional rocking chair designs (see FIG. 1), which commonly utilize runners or rails that maintain only one point of contact with the support surface during rocking. By maintaining more than one contact point, the stability and safety of the chair 10 is improved. As illustrated in FIG. 3, a first foot 36*a* is provided on a forward portion of the frame side assembly 20, generally beneath the front leg portion 24 of the frame loop. Second and third feet 36*b* and 36*c* are provided at respective ends of the support runner 34, with the third foot 36*c* generally being beneath the lower end of the rocker mechanism 32 for supporting the brunt of the weight of the user and chair 10 when the chair 10 is rocked backwards. During use of the chair 10, when the chair 10 is in its forward position, and generally when the chair 10 is not being used to rock, the first and second feet 36*a* and 36*b* can sufficiently support the chair 10. As shown, the third foot 36*c* also maintains contact with the ground, but is not necessary for supporting the chair 10 when in such a forward position. When the chair 10 is rocked backwards, the first foot 36*a* lifts away from the ground such that the second and third feet 36*b* and 36*c* support the chair 10.

As noted, the third foot 36*c* generally maintains contact with the support surface regardless of the position of the chair 10. However, in alternate designs, the third foot 36*c* can be designed to lift off the ground when the chair 10 is in a forward position without departing from the spirit and principles of the present invention.

Referring to FIG. 6, the rocker mechanism 32 can comprise an axially-elongated tubular member 38 pivotally attached at a first end via a pivot joint 40 and pivot pin 42 to the rear leg portion 28 of the frame loop, and received at a second end within a sleeve 44. More particularly, the second end is attached to a spring 46 contained within the sleeve 44 and fixed itself at a lower end to the sleeve 44. The lower end of the sleeve 44 is pivotally connected to the support runner 34 via a universal joint 48 and pivot pins 50 and 52 for movement with the rocking chair 10. The universal joint 48 permits some flexibility in movement to accommodate seated users of varying sizes and weights without compromising the users' ability to recline and rock in the chair. In an alternate design, the lower end of the sleeve 44 may merely be provided with the third foot 36*c* for direct contact with the support surface in absence of the support runner 34. In a still further alternate design, the tubular member 38 and sleeve 44 of the rocker mechanism 32 can be designed to move with the rocking movement of the chair 10 such that the lower end of the sleeve 44 (i.e., the third foot 36*c*) lifts off the ground when the chair 10 is in a forward position and contacts the ground as the chair 10 rocks backwards to support the chair 10 in a rearward position.

Again referring to FIG. 6, a fulcrum 54 is provided on the forward end of the support runner 34 and is pivotally connected to the lower support portion 27 of the frame loop for effecting a pivoting of the frame loop relative to the support runner 34. This pivoting is what causes the chair 10 to rock. In general, as a seated user shifts her weight backward—for example, by leaning back on the backrest panel 16—the frame loop pivots backwards on the fulcrum 54. As the frame loop pivots backward, the tubular member 38 of the rocker mechanism 32 moves with the frame loop, generally in a backwards and downwards direction towards the rear end of the support runner 34. As the tubular member 38 moves, it slides downwards within the sleeve 44 applying a force on the spring 46, which dampens the tubular member 38 and prevents the chair 10 from tipping over. The spring 46 further biases the tubular member 38 in the opposite direction—i.e., upwards out of the sleeve 44 and upwards and forwards relative to the rear end of the support runner 34. This movement of the tubular member 38 (often combined with an associated shift in the seated user's weight) pivots the frame loop forwards on the fulcrum 54. During such pivoting movement, the rocker mechanism 32 in the illustrated embodiment pivots relative to both the frame loop and the support runner 34 so as to maintain contact with both. As a result, in the illustrated embodiment, the rocker mechanism 32 does not lift off the ground during rocking, which improves safety of the chair 10 by not having parts that someone can get pinched or crushed by—e.g., by getting a foot caught between the chair 10 and the ground or support surface. In alternate designs, the lower end of the rocker mechanism 32 can move with the frame loop and contact the ground or support surface with movement of the chair 10.

In alternate designs of the chair of the present invention, such as designs that do not use a closed frame loop as shown, the fulcrum 54 can be connected to a rear leg member or at least a horizontal extension thereof, and still assist the rocking movement of the chair in combination with a rocker mechanism 32, as described above.

The frame members for the frame side assemblies 20L and 20R are preferably disposed within generally parallelly extending vertical planes. Referring to FIGS. 2 and 4-5, the frame side assemblies 20 are connected together by generally U-shaped cross-members 56, each pivotally attached to the front and rear leg portions 24 and 28 of an associated frame side assembly 20, as well as to each other for pivotal movement between set-up and collapsed conditions of the chair 10. More particularly, each cross member 56 comprises a front portion 58, a central front-back portion 60, and a rear portion 62. The front portion 58 is pivotally connected to the front leg portion 24 of a respective frame side assembly 20. Likewise, the rear portion 62 is pivotally connected to the rear leg portion 28 of the same frame side assembly 20. The central front-back extending portion 60 of each cross-member 56 extends between the front and rear portions 58 and 62, and defines a seat support member for the chair 10. Indeed, as illustrated in FIG. 2, the seat panel 14 extends between these seat support portions of the cross-members 56 during a set-up condition of the chair 10 to define the seat of the chair 10.

Figure 7:
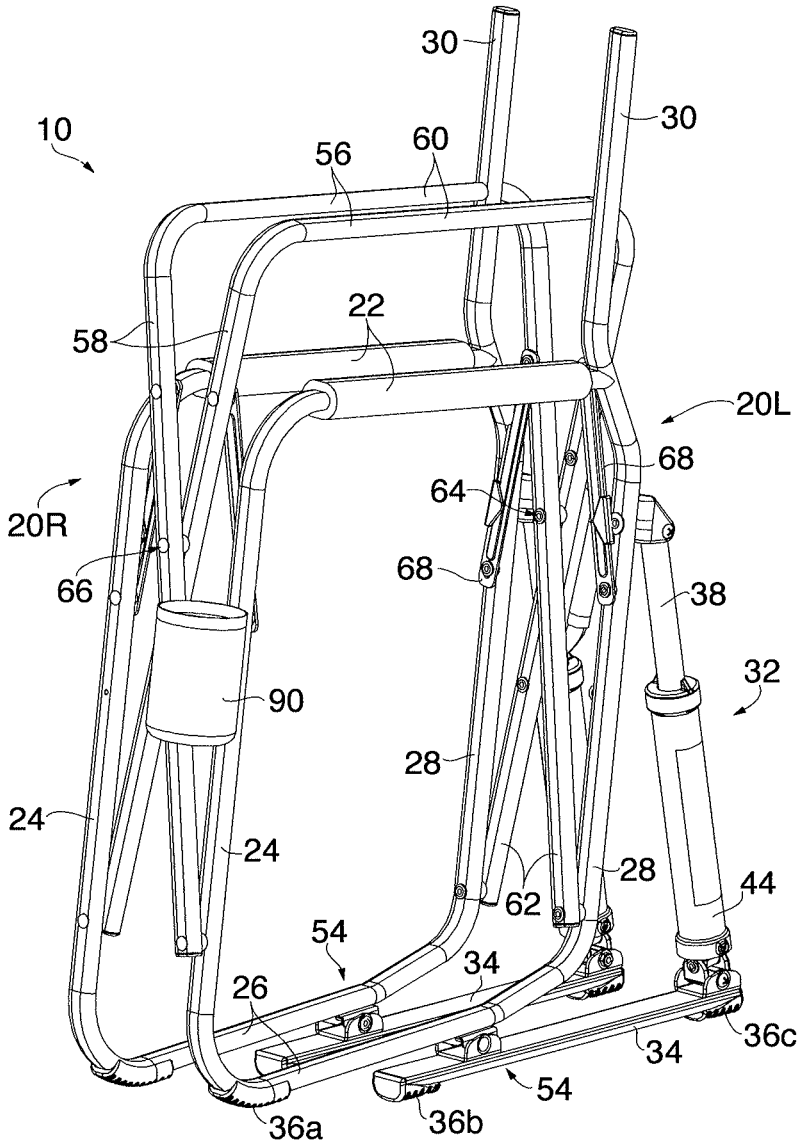
FIG. 7 is a perspective view of the rocking chair of FIG. 2 in a folded condition.

As can be seen, the rear portions 62 of the cross-members 56 are connected between respective rear leg portions 28 of the chair frame 12, and generally form a pivotable rear X-frame connected at a central pivot point 64, which opens into the shape of an "X" when the chair 10 is opened to the set-up condition, as shown in FIG. 2, and which collapses when the chair 10 is folded up, as shown in FIG. 7. Similarly, the front portions 58 of the cross-members 56 are connected between respective front leg portions 24 of the chair frame 12, and likewise form a pivotable front X-frame connected at a central pivot point 66, which also opens into the shape of an "X" when the chair 10 is opened to the set-up condition, and which collapses when the chair 10 is folded up. Accordingly, the frame side assemblies 20L and 20R are joined each to the other, to enable, in part, transverse, or left-right, folding of the frame 12, by the pair of movable X-frame connector assemblies 56 formed by the pivotable interconnection of the cross-members 56. That is, when the chair 10 is being collapsed, the cross members 56 are pivoted to close the X-frame so that the cross-members 56 are flattened and brought adjacent to one another. As the cross-members 56 are flattened, the frame side assemblies 20L and 20R are brought inward and adjacent to one another as well.

Figure 8:
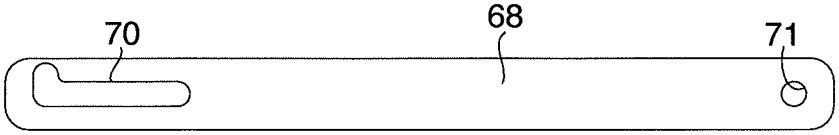
FIG. 8 is a planar view of a support brace that may be used in embodiments of a collapsible and portable rocking chair in accordance with the present invention.

The cross members 56 also provide support for the chair frame 12 in the open, set-up condition by balancing and redistributing the forces exerted on the chair frame 12 by a person seated on the seat panel 14 and leaning back on the backrest panel 16. As shown in FIGS. 2 and 4-5, the cross-members 56 can be further secured to the frame 12 by using support braces 68 pivotally connected between a cross-member 56 and the frame loop. For example, referring to FIGS. 4 and 5, the terminal lower end of the front portion 58 of one cross member 56 is pivotally connected to the front leg portion 24 of one of the frame side assemblies (e.g., 20L), and the terminal lower end of the rear portion 62 of the cross member 56 is pivotally connected to the rear leg portion 28 of the same frame side assembly 20, typically at a lower portion of said leg portions 24 and 28. The terminal lower ends of the front and rear portions 58 and 62 of the other cross member 56 are similarly pivotally connected to the front and rear leg portions 24 and 26 of the other frame side assembly (e.g., 20R). The upper ends of the front and rear portions 58 and 62 of each cross member 56 are connected to respective front and rear leg portions of the opposite frame side assembly 20 via the support braces 68. More particularly, each support brace 68 has a first pivot opening connected to a cross member 56 and a second pivot opening connected to a frame side assembly 20. As the cross members 56 are pivoted about the central pivot points connecting them together (i.e., front central pivot point 66 and rear central pivot point 64, respectively illustrated in FIGS. 4 and 5), they pull the frame side assemblies 20L and 20R together via the support braces 68. When the chair 10 is in its set-up condition, the cross-members 56 are in an open X-shaped configuration, and rest on the support braces 68, as illustrated in FIGS. 4 and 5, which limit further opening of the cross members 56 while distributing the weight of the seated user through the frame 12. As discussed further with respect to FIG. 8, the second pivot opening can take the form of an L-shaped slot that facilitates opening and closing of the chair 10.

The chair frame 12 is generally adapted to rest on a generally horizontally oriented supporting surface, such as a floor or the ground, in a set-up condition. The chair 12 is generally stabilized on the supporting surface by the first, second and third feet 36*a*, 36*b* and 36*c*, respectively. In a forward position of the chair 10, the chair 10 acts as a normal, fully stabilized chair, and is supported by at least the first foot 36*a* and the second foot 36*b*, even if the user is leaning on the backrest panel 16. If the user desires to rock in the chair 10, the user can shift her weight backwards, for example, by leaning and pushing backwards on the backrest panel 16, which will cause pivoting of the frame loops of the frame side assemblies 20 relative to the fulcrums 54 on each support runner 34. As the chair 10 pivots backwards, the first foot 36*a* lifts off the ground, but the chair 10 remains stabilized by the second and third feet 36*b* and 36*c* maintaining contact with the support surface. As the chair 10 pivots forwards, the first foot 36*a* moves into contact with the support surface.

In the set-up condition, the flexible seat panel 14 defines a generally taut chair seat support and the flexible backrest panel 16 defines a generally taut chair back support, for collectively accommodating an upright, seated chair occupant. The seat panel 14 and the backrest panel 16 are secured to portions of the chair frame 12 that help define and provide the seat support and the back support for the occupant. As shown, the backrest support members 30 are preferably mounted relative to the rear leg portions 28 to extend upward therefrom. In alternate embodiments of the chair, the backrest support members 30 can be removed from the frame loops during collapsing and storage of the chair, or in further alternate embodiments, foldable to a position adjacent to either the armrest portions 22 or the rear leg portions 28 during collapsed of the chair. Additionally, the backrest panel 16 can be removed from the chair frame 12—either from the backrest support members 30 or with said members 30—to provide some slack to the backrest panel 16. This helps improve the facility and safety with which the chair is set-up and collapsed, as it is generally known in the art for chairs with cross-members of the type shown and described herein that there is a great stress on the frame side assemblies 20 when moving the cross members 56 to the set-up condition of the chair 10.

More particularly, as the cross members 56 are moved from a relaxed state—where they are disposed adjacent to one another (FIG. 7)—to a set-up state—where they generally form an X-shape with one another (FIG. 2)—the arc in the side-to-side direction of the cross members 56 forces the upper ends of each frame side assembly to bow outward—essentially creating a trapezoidal arrangement in the chair frame 12. This action causes the upper end of the frame side assemblies 20, and more particularly, the backrest support members 30 to push outwardly. Where the backrest panel 16 is connected to the backrest support members 30, the panel material is stressed and provides resistance to the bowing motion of the chair frame 12. As this resistance increases, opening and closing of the chair 10 may be difficult for certain users. The increased tension on the cross members 56 also increases the risk of the user pinching herself during set-up and breakdown of the chair 10. Further, the increased tension on the cross-members could damage the backrest panel 16, warp the chair frame 12, or place unwanted stress on the joints and pivot pins of the chair frame 12.

An additional solution to the increased tension created in a chair having a design in accordance with the present invention is to provide a slot, and more particularly an L-shaped slot 70, on at least one of the support braces 68 connecting the cross members 56 to the frame side assemblies 20. As shown more particularly in FIG. 8, a support brace 68 includes a first pivot hole 71 on one end pivotally connected to a cross member 56 and the L-shaped slot 70 on the opposite end pivotally connected to a frame side assembly 20. Both connections are effected by a rivet or pivot pin. By using the support brace illustrated in FIG. 8, the bowing forces and the lateral motion normally imparted into the frame side assemblies 20 is accommodated by the longitudinal dimension of the slot 70. The lateral dimension of the slot 70 acts to lock the seat support in an open, set-up condition—especially when the weight of the seated user is applied to the chair 10. In normal designs of such chairs, when weight is applied to the chair, the seat panel 14 tends to flex and pull the cross members 56 inwardly. The L-shaped slot 70 prevents this action and as a result works to maintain a desired comfort level for the chair 10 when being used to support a seated user.

Alternate designs for the side frame assemblies and the leg portions thereof can be used without departing from the focus of the present invention. For example, as illustrated in the embodiment of FIG. 2, the frame assemblies 20L and 20R are formed by a closed frame loop mounted on a fulcrum point 54 of a support runner 34. A collapsible and portable rocking chair in accordance with the present invention can also utilize an open frame construction whereby the side frame assemblies are formed of interconnected frame members to define independent front and rear legs. In such alternate designs, the frame is still connected to a fulcrum pivot point that facilitates rocking of the chair back and forth—for example, the rear legs, or extensions thereof, can be mounted to a fulcrum point. As noted above, in such alternate designs, each side frame assembly, regardless of construction, maintains at least two contact points with the support surface to ensure sufficient safety and structural integrity during use of the chair.

Additionally, the rocker mechanism 32 can take a variety of forms without departing from the spirit and principles of the present invention. As shown in FIG. 6, the rocker mechanism 32 comprises a compression spring 46 disposed within a sleeve 44 receiving a tubular member 38 extending from the rear of each frame side member assembly 20. In alternate designs, this rocker mechanism 32 can be replaced by torsion springs provided on the lower portion of each frame side member assembly—for example, at the fulcrum point of each frame assembly on a support runner. Further, the rear rocker mechanism design can be replaced by a front rocker mechanism design, namely, a compression spring utilized in connection with the design of the front legs of the chair. Still further, combinations of springs may be used, for example, compression springs provided on both the front legs of the chair, as well as on a rearwardly projecting member to prevent the chair from tipping over as it is rocked backwards.

An alternate embodiment of a collapsible and portable rocking chair in accordance with the present invention is illustrated in FIG. 9 and generally designated by reference numeral 110. Here, the chair frame 112 utilizes an open frame construction generally associated with standard folding chairs. Indeed, the chair 110 shown in FIG. 9 is adapted for front-to-back collapsing, unlike the chair 10 shown in FIG. 2, which collapses in a side-to-side manner. As shown, the chair frame 112 comprises left-hand and right-hand side frame assemblies 120 of substantially identical, but mirrored, construction. Each side frame assembly 120 includes an armrest 122, a front leg 124, a rear leg 128, a seat support member 129, and a backrest support member 130, all interconnected by pivotal connections that facilitate folding of the chair 110 between a set-up condition, as shown, and a folded condition. Each side frame assembly 120 further includes a fulcrum point 154 provided on a frame member 155 extending from an intermediate point on the rear leg 128 to the ground or support surface on which the set-up chair 110 rests. As shown, the fulcrum member 155 has a fulcrum pivot point 154 on its lowermost end that contacts the ground surface and aids rocking of the chair 110.

Referring again to FIG. 9, each of the front and rear legs 124 and 128 includes a built in rocker mechanism 132. As illustrated, each leg member includes a sleeve 144 or tube that receives the lower-most end of a respective leg member 124 or 128. The leg member 124 or 128 rests atop a spring 146 disposed within the sleeve 144. During rocking movement of the chair 110, the leg member 124 or 128 presses down on the spring 146, which dampens the force of the chair frame 112 pressing down on the spring 146, while also biasing the leg member 124 or 128 in the return direction. With such a rocker mechanism 132 provided on the front and rear legs 124 and 128, the mechanisms 132 work in combination for a fluid rocking motion. That is, when a seated user leans back in the chair 110, the rear legs 128 slide within the respective sleeves 144, allowing the chair frame 112 to recline while pressing down on the springs 146 within the sleeves 144. The springs 146 dampen the rearward force of the chair 110 while biasing the rear legs 128 upwardly, and as a result, the chair 110 in a forward direction. In accordance with a normal rocking motion, when the user's weight shifts forward, the chair frame 112 likewise moves forward. The rear legs 128 slide up from within their respective sleeves 144 and removes the force on the rear springs 146. At the same time, the front legs 124 slide within their respective sleeves 144, allowing the chair frame 112 to move forward, while pressing down on the springs 146 contained within the sleeves 144. The springs 146 dampen the rearward force of the chair 110 while biasing the front legs 124 upwardly, and as a result, the chair 110 in a rearward direction. In accordance with a normal rocking motion, when the user's weight shifts backward, the chair frame 112 likewise moves backward. The front legs 124 slide up from within their respective sleeves 144 and removes the force on the front springs 146. As so designed, the sleeves 144 on each of the front and rear legs 124 and 128 maintain contact with the ground surface at all times during use of the chair 110.

In alternate designs of the chair shown in FIG. 9, a rocker mechanism 132 can be provide on the front leg or the rear leg without departing from the intended operation of the chair 112 as a rocking chair.

Referring again to the design illustrated in FIG. 2, when the chair 10 is folded up for transportation and/or storage, the user simply presses inwardly on each side of the frame 12, which causes the cross-members 56 to pivot relative to each other about their front and back pivot connections 66 and 64 from the X-shape associated with the set-up condition of the chair 10 to positions whereby the cross-members 56 are generally parallelly disposed relative to each other, as shown in FIG. 7. As the cross-members 56 pivot relative to one another about the central pivot points, the frame side assemblies 20L and 20R move together within their parallel planes to form the flat collapsed condition of the chair 10. To set-up the chair 10, the user simply pulls outwardly on each frame side assembly 20L and 20R until the cross-members 56 pivot to the desired X-shaped conditions. Alternatively, the user can separate the cross members 56 and push them outwardly until the chair frame 12 snaps into its set-up condition.

In an alternate approach for collapsing the chair 10 shown in FIG. 2, the seat panel 14 is provide with a handle 80 on one or both sides of the frame 12. Generally, the handle 80 is aligned with the central front-back sections 60 of the cross members 56 that define with width of the chair seat. Such handles 80 may also act as carrying handles for the fully collapsed chair 10. To fold up the chair 10, the user pulls up on one of the handles 80 mounted to the seat while simultaneously holding firmly on the armrest portion 22 of the frame side assembly 20 adjacent to the handle 80 when the chair 10 is in the set-up condition. When tautness and rigidity of the seat panel 14 is desired or required for comfortable use of the chair 10, folding of the chair 10 in a standard way—i.e., by pressing on the chair frame members to effect folding and collapsing of the chair frame 12—may be difficult. Use of a handle, such as handle 80 described above, makes the folding process less difficult.

For the chair 110 design illustrated in FIG. 9, the user can fold the chair 110 for transportation and/or storage by pressing on a seat support member 129 and/or a backrest support member 130 to push the members towards each other. This causes the chair frame 112 to collapse in a front-to-back manner, resulting in a flat, collapsed chair 110.

Additionally or alternatively, a transportation handle 82 can be provide on the rear portion 62 of one of the cross members 56. When the chair 10 is collapsed, such a handle 82 can be used to carry the folded chair 10 from place to place.

The portable and collapsible rocker chair in accordance with the present invention can also be fitted with additional features to improve upon their intended use as a portable chair. For example, a cup holder 90, as illustrated in FIG. 2, can be attached to the chair frame 12 without affecting the chair's ability to rock or be easily collapsed to a compacted bundle for transportation and/or storage.

In accordance with preferred embodiments of the present invention, the seat and backrest panels 14 and 16 may be made from fabric or other suitable flexible, durable and weather resistant sheet material. In accordance with preferable designs of the chair, the panels 14 and 16 are flexible to accommodate the seated user, thereby improving the comfort level of the chair. In the set-up condition of the chair, the seat panel 14 and the backrest panel 16 extend between the side assemblies 20 and are generally taut for supporting a seated user. When the chair is collapsed to a folded condition, such as shown in FIG. 7, the panels 14 and 16 become flaccid and fold within the collapsed condition of the chair. Thus, the design of the present invention can be used with chairs of varying heights, such as an event chair (shorter leg length) or stool (longer leg length) without affecting operation and use of the chair in accordance with the present invention. The seat panel 14 preferably provides a 17-inch seat height for the chair when in a set-up condition for use. The backrest panel 16 preferably provides a high profile capable of supporting the user's upper back, neck and head, though various dimensions for the backrest panel 16 may be used without affecting operation of the chair in accordance with the present invention.

In alternate designs, the seat and backrest panels 14 and 16 can be rigid and collapsible with the chair frame 12. For example, the panels 14 and 16 can be formed from plastic panels that hinge in half when the chair 10 is folded, but which snap into a solid panel when the chair 10 is set-up.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A collapsible and portable rocking chair comprising:

an articulated chair frame defining a back support and a seat support, wherein said frame has a set-up condition and a collapsed condition;

a seat panel mounted on the seat support of the frame;

a backrest panel mounted on the back support of the frame;

wherein said chair frame comprises a pair of side frame assemblies of opposite hand disposed in generally parallelly extending and transversely spaced apart opposing relation to each other, each of said side frame assemblies having a plurality of generally axially elongated frame members being interconnected for pivotal movement relative to one another about generally transversely extending pivot axes, said frame members including:

a front leg member;

a rear leg member;

a seat support member defining a respective side of the seat support;

a back support member defining a respective side of the back support; and a fulcrum member defining a fulcrum point at a terminal end thereof adapted for contacting the ground surface upon which the chair sits in the set-up condition and for supporting the chair frame, and about which said chair frame can move between forward and rearward positions;

at least one rocker mechanism attached to the chair frame for supporting the chair during movement of the chair frame between said forward and rearward positions.

2. The collapsible and portable rocking chair according to claim 1, wherein said rocker mechanism is attached to at least one of the front leg member and the rear leg member of each side frame assembly.

3. The collapsible and portable rocking chair according to claim 2, wherein the rocker mechanism comprises a sleeve associated with at least one of the front leg member and the rear leg member, said sleeve further housing a spring to which said leg member is connected.

4. The collapsible and portable rocking chair according to claim 3, wherein a sleeve is associated with the lower-most end of each of the front leg member and the rear leg member of each side frame assembly, each said sleeve housing a spring to which a respective leg member is connected.

5. The collapsible and portable rocking chair according to claim 1, wherein said fulcrum member extends from an intermediate point on the rear leg member.

6. The collapsible and portable rocking chair according to claim 1, wherein each side frame assembly further comprises an armrest.

7. The collapsible and portable rocking chair according to claim 6, further comprising a common pivotal connection between the upper extremity of said front leg member, the upper extremity of said rear leg member and a forward portion of the armrest, and a pivotal connection between the rearward extremity of the armrest and an intermediate portion of the back support member such that the armrest is generally horizontally disposed when the chair frame is in the set-up condition.

8. The collapsible and portable rocking chair according to claim 1, wherein the seat support members of the side frame assemblies are interconnected by at least one transversely extending seat connector member and the back support members of the side frame assemblies are interconnected by at least one transversely extending back connector member.

9. The collapsible and portable rocking chair according to claim 1 wherein the seat panel and the backrest panel are made of a flexible material.

10. A collapsible and portable rocking chair comprising:

a pair of side frame assemblies including a front leg member, a rear leg member, a back support member, and a fulcrum member defining a fulcrum point at a terminal end thereof adapted for contacting the ground surface upon which the chair sits in a set-up condition thereof and about which the chair can move between forward and rearward rocking positions, said members comprising each side frame assembly being pivotally interconnected for folding movement between the set-up condition of the chair and a collapsed condition of the chair;

at least one rocker mechanism attached to each side frame assembly for supporting the chair during movement between said forward and rearward positions; and a flexible seat and a flexible backrest secured to and extending between the side frame assemblies.

11. The collapsible and portable rocking chair according to claim 10, wherein said rocker mechanism is attached to at least one of the front leg member and the rear leg member of each side frame assembly.

12. The collapsible and portable rocking chair according to claim 11, wherein the rocker mechanism comprises a sleeve associated with at least one of the front leg member and the rear leg member, said sleeve further housing a spring to which said leg member is connected.

13. The collapsible and portable rocking chair according to claim 12, wherein a sleeve is associated with the lower-most end of each of the front leg member and the rear leg member of each side frame assembly, each said sleeve housing a spring to which a respective member is connected.

14. The collapsible and portable rocking chair according to claim 10, wherein said fulcrum member extends from an intermediate point on the rear leg member.

15. The collapsible and portable rocking chair according to claim 10, wherein each side frame assembly further comprises a seat support member pivotally interconnected with other members of said side frame assembly defining a seat support for supporting the flexible seat.

16. The collapsible and portable rocking chair according to claim 10, wherein each side frame assembly further comprises an armrest.

17. The collapsible and portable rocking chair according to claim 16, further comprising a common pivotal connection between the upper extremity of said front leg member, the upper extremity of said rear leg member and a forward portion of the armrest, and a pivotal connection between the rearward extremity of the armrest and an intermediate portion of the back support member such that the armrest is generally horizontally disposed when the chair frame is in the set-up condition.

18. The collapsible and portable rocking chair according to claim 10, wherein the side frame assemblies are interconnected by at least one transversely extending connector mechanism.

19. The collapsible and portable rocking chair according to claim 18, wherein the connector mechanism comprises a pair of connector members pivotally connected to each other at a respective intermediate portion thereof about a pivot axis and pivotally connected at terminal extremities thereof to each of the side frame assemblies.

20. The collapsible and portable rocking according to claim 19, wherein each side frame assembly further comprises at least one of an armrest and a seat support member pivotally interconnected with other members of said side frame assembly defining a seat support for supporting the flexible seat, and further wherein the connector mechanism comprises a first connector mechanism constituting a first pair of connector members transversely pivotally connected between the rear leg members and the back support members of the respective side frame assemblies; and further comprising a second connector mechanism constituting a second pair of connecting members transversely pivotally connected between the front leg members and the at least one of said armrest and said set support member of the respective side frame assemblies.

* * * * *

UNITED STATES PATENT AND TRADEMARK OFFICE

CERTIFICATE OF CORRECTION

PATENT NO. : 9,282,824 B2
APPLICATION NO. : 14/746117
DATED : March 15, 2016
INVENTOR(S) : Daniel R. Grace It is certified that error appears in the above-identified patent and that said Letters Patent is hereby corrected as shown below:

In the Claims

Claim 20, Column 16, line 16: after "rocking" insert --chair--.

Signed and Sealed this
Fifth Day of July, 2016

Michelle K. Lee

Michelle K. Lee
*Director of the United States Patent and Trademark Office*